US006788198B2

(12) United States Patent
Harshaw

(10) Patent No.: US 6,788,198 B2
(45) Date of Patent: Sep. 7, 2004

(54) SYSTEM FOR VERIFYING DETECTION OF A FIRE EVENT CONDITION

(76) Inventor: Bob F. Harshaw, P.O. Box 418, Ottawa, KS (US) 66067

( * ) Notice: Subject to any disclaimer, the term of this patent is extended or adjusted under 35 U.S.C. 154(b) by 168 days.

(21) Appl. No.: 10/095,809

(22) Filed: Mar. 12, 2002

(65) Prior Publication Data

US 2003/0174056 A1 Sep. 18, 2003

(51) Int. Cl.[7] ..... G08B 19/00
(52) U.S. Cl. ..... 340/522

(56) References Cited

U.S. PATENT DOCUMENTS 6,314,054 B1 * 11/2001 Priebsch ..... 367/93
6,344,802 B1 * 2/2002 Otsuka et al. ..... 340/517
6,414,594 B1 * 7/2002 Guerlain ..... 340/506
6,597,287 B1 * 7/2003 Steinel ..... 340/541

* cited by examiner

*Primary Examiner*—Daryl Pope
(74) *Attorney, Agent, or Firm*—Dale J. Ream

(57) ABSTRACT

A system for verifying the detection of a fire event by a fire detection device utilizing multiple air condition sensors includes a programmable logic circuit that evaluates whether input data supplied thereto by the sensors satisfies predetermined threshold parameters. If the input data matches one particular parameter, the other threshold parameters are decreased and evaluation frequency is increased. The circuit energizes an alarm if input data from the sensors satisfies the particular parameter and at least one of the decreased parameters or if the input data satisfies at least two non-decreased parameters. Therefore, a fire event sensed by one sensor is verified by another sensor before causing an alarm. At power-up, the circuit compares initial input data with the predetermined parameters and modifies the parameters if the input data is within respective predetermined ranges. This also decreases false alarms.

20 Claims, 3 Drawing Sheets

SYSTEM FOR VERIFYING DETECTION OF A FIRE EVENT CONDITION

BACKGROUND OF THE INVENTION

This invention relates generally to fire event sensing devices and, more particularly, to a system for verifying and improving the accuracy of detection of fire events by fire detection devices that utilize multiple fire event sensors so as to reduce false alarms.

Various devices are known in the art which utilize more than one air condition sensor for sensing predetermined ambient air conditions indicative of a fire event. Although assumably effective for their intended purposes, existing fire event detection devices frequently sound false alarms. An ambient air condition sufficient to activate an alarm may, in fact, be caused by some event other than a fire. Therefore, existing devices often erroneously energize an alarm when a true fire event does not exist.

Therefore, it is desirable to have a system for use with multi-sensor fire detection systems that reduces the threshold parameters of other sensors when a first sensor supposedly indicates a fire event and then energizes an alarm only if the fire event is verified by more than one sensor. Further, it is desirable to have a system that modifies predetermined threshold parameters if sensed air conditions at initial power-up indicate a likelihood of a climate-induced false alarm unless the parameters are modified.

SUMMARY OF THE INVENTION

A system for verifying and improving the accuracy of detection of a fire event by fire detection devices utilizing multiple air condition sensors includes a programmable logic circuit having a plurality of predetermined threshold parameters. Each threshold parameter corresponds to a respective air condition sensor in the fire detection device and includes a data type corresponding to the data type of an ambient air measurement taken by a respective sensor. The logic circuit compares input data received from the air condition sensors with the predetermined parameters. If this comparison reveals that data from a particular sensor satisfies a corresponding threshold parameter, the circuit decreases the levels of the other threshold parameters other than the parameter corresponding to the particular sensor. The circuit also increases the frequency with which all of the sensors are sampled. Then, if data from the sensors satisfies the corresponding threshold parameter as well as at least one of the decreased threshold parameters, the logic circuit energizes an alarm. Therefore, decreasing the other parameters and making another data comparison causes a quick verification that a true fire event had been sensed by the first sensor and avoids possible false alarms.

Further, the logic circuit compares data from the air condition sensors at initial power-up to the predetermined threshold parameters and modifies appropriate parameters that appear likely to cause a false alarm. In other words, if an ambient air condition almost satisfies (or even exceeds) a corresponding parameter at power-up, then an erroneous alarm activation is likely based solely on a normal environmental condition. For example, a fire detection device may include an air condition sensor that senses temperature and which corresponds to a threshold parameter of, say, 135° F. If the sensor indicates at power-up that the ambient air temperature is already 127° F., then the logic circuit may determine that the threshold parameter should be raised by a predetermined amount so as to avoid a false alarm (which would occur in this example if the temperature increased to 135° F., e.g., in a hot attic in the summertime). Therefore, the logic circuit is able to adapt the sensors to the environment at power-up so as to reduce the incidence of false alarm and, thus, verify the accuracy of a detection of a fire event prior to sounding an alarm.

Therefore, a general object of this invention is to provide a system for verifying detection of a fire event by a fire detection device that utilizes more than one air condition sensor.

Another object of this invention is to provide a system, as aforesaid, that decreases the threshold parameters corresponding to other sensors if a particular threshold parameter is satisfied by input data received from the sensors.

Still another object of this invention is to provide a system, as aforesaid, that energizes an alarm if the data from the sensors satisfies both the threshold parameter corresponding to the particular sensor and at least one decreased parameter.

Yet another object of this invention is to provide a system, as aforesaid, in which an alarm is immediately activated if data from the sensors satisfies at least two corresponding threshold parameters.

A further object of this invention is to provide a system, as aforesaid, which modifies appropriate threshold parameters if initial input data received by the logic circuit at power-up indicates the likelihood of a false alarm due to environmental conditions.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
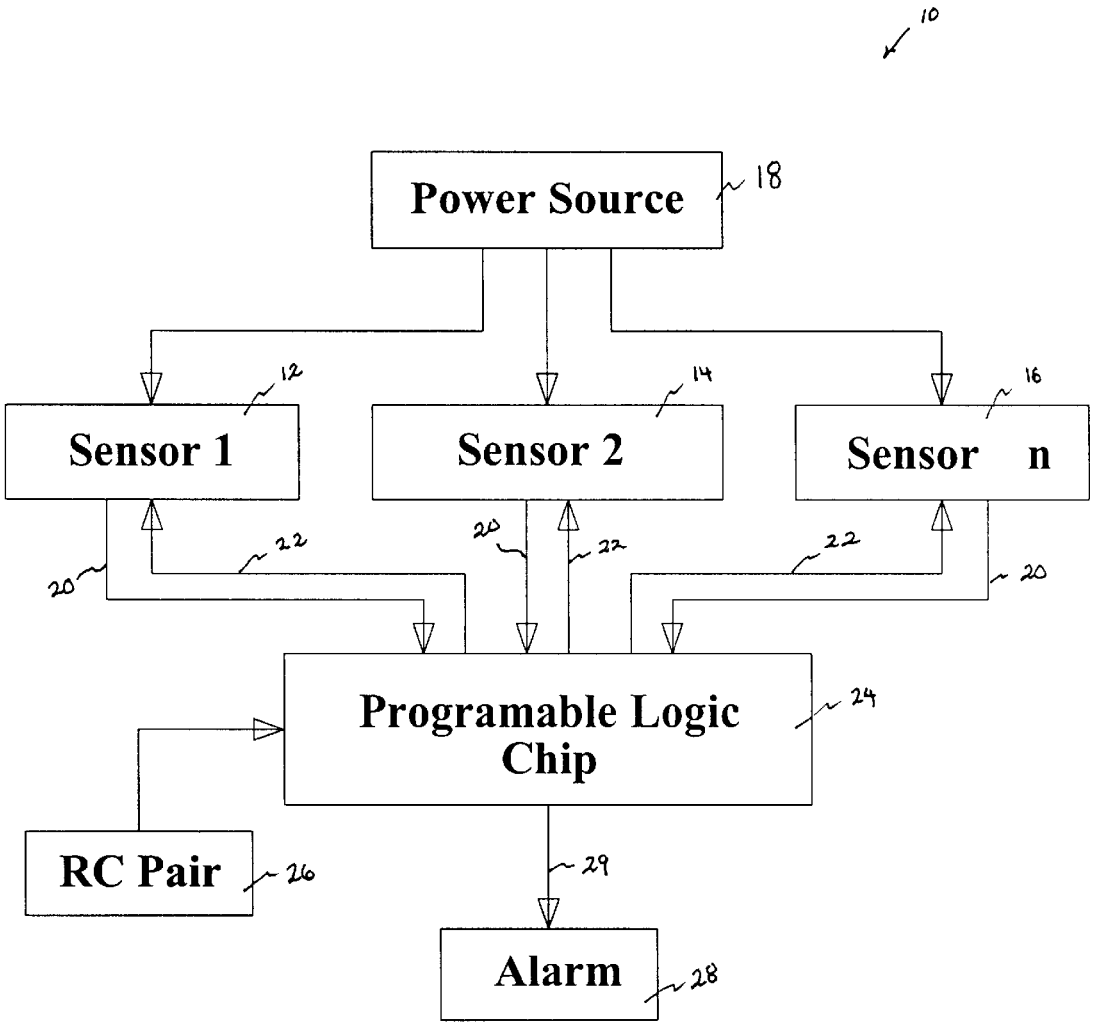
FIG. 1 is a block diagram of a preferred embodiment of a system for verifying the detection of a fire event condition.

A system for verifying and improving the detection of a fire event condition will now be described in detail with reference to FIGS. 1 through 3 of the accompanying drawings. Although the preferred embodiment described herein and as shown in FIG. 1 shows a system 10 utilized in conjunction with three sensors, it is understood that the system 10 is adaptable to be utilized with fire detection devices having a plurality of sensors. It is further understood that the system 10 described herein is not constrained to a particular fire event detection device, but rather is adaptable for use in any such device.

A device employing the present system 10 would include a plurality of ambient air condition sensors 12, 14, 16 electrically connected to a power source 18 such as a battery (FIG. 1). During routine operation, the sensors 12, 14, 16 send a data stream 20 to a programmable logic circuit 24 according to a predetermined clock cycle. The clock cycle may be provided to the logic circuit 24 by a conventional resistor/capacitor (RC) pair 26. At predetermined time intervals of the RC pair 26, the logic circuit 24 transmits a signal 22 to each sensor to send input data to the logic circuit 24 for analysis. In other words, the logic circuit 24 regularly samples data from each sensor. The data stream (input data) 20 received from the sensors 12, 14, 16 includes measurements of respective ambient air conditions, such as smoke, heat, carbon dioxide, or other conditions depending on the sensors included in the detection device. The logic circuit 24 is adapted to generate signals whereby to initiate predetermined actions depending upon its analysis of the data stream 20, such as energizing an alarm 28 or modifying parameters, as to be described in detail below.

The logic circuit 24 includes a plurality of threshold parameters, each parameter having a data type corresponding to a data type of an air condition measurement provided by a corresponding air condition sensor. Each threshold parameter has a predetermined value although these parameters may be modified in that the logic circuit is reprogrammable.

During routine operation, the logic circuit 24 compares input data from the data stream 20 with corresponding predetermined threshold parameters. In a typical fire detection system, a fire event is indicated if data from even one sensor satisfies a corresponding threshold parameter. In the present system, however, input data which satisfies a single corresponding threshold parameter is not conclusive; instead, such an evaluation merely causes more tests/actions to be undertaken, whereby to verify the condition prior to energizing the alarm 28.

Figure 3:
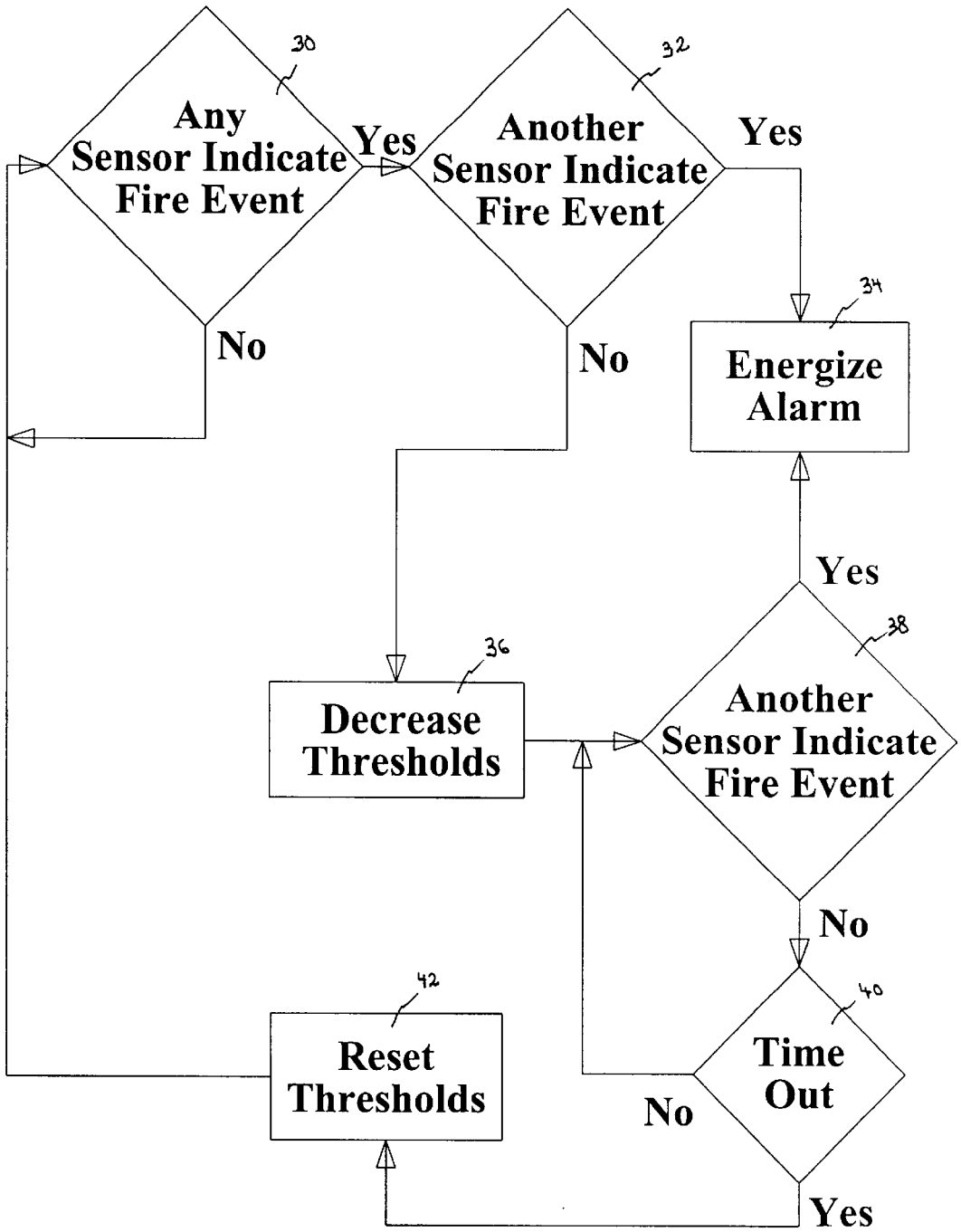
FIG. 3 is a flow chart showing the logic utilized by a programmable logic circuit according to the system of FIG. 1.

More particularly, when at least one threshold parameter is satisfied upon a comparison of input data and respective threshold parameters by the logic circuit 24 as indicated at block 30 of FIG. 3, the logic circuit 24 initiates additional test actions. However, if such a condition is not found, then routine operation is continued. If such a condition is found, then the logic circuit 24 immediately evaluates the input data to see if at least two threshold parameters have been satisfied, as indicated at block 32 of FIG. 3. If so, the detection of a true fire event is assumed and the logic circuit 24 generates an appropriate output signal 29 to energize the alarm 28 without further testing or delay, as indicated at block 34.

However, where only a single threshold parameter is satisfied by the input data, the logic circuit 24 decreases all of the threshold parameters except the particular threshold parameter that is already satisfied by the air condition measurement of a corresponding sensor, as indicated at block 36. The logic circuit 24 is adapted to request input data from the sensors 12, 14, 16 at more frequent intervals so as to determine if a real fire event is occurring. The logic circuit 24 compares this input data with respective decreased threshold parameters. If the input data satisfies the particular threshold parameter initially indicated as well as at least one corresponding decreased threshold parameters, then a true fire event is assumed and the logic circuit 24 generates an appropriate output signal 29 to energize the alarm 28, as indicated at blocks 38 and 34 of FIG. 3, respectively. If these more frequent comparisons at decreased threshold levels do not indicate a fire event after a predetermined time, the logic circuit 24 resets all threshold parameters to their respective original values, as indicated at blocks 40 and 42 of FIG. 3, respectively. In this case, the initially satisfied parameter is deemed to have been a false alarm and regular testing is resumed at predetermined time intervals.

For example, in a fire event detection device having a smoke, heat, and carbon monoxide sensor and where a threshold parameter corresponding to smoke is satisfied, the logic circuit would decrease the threshold parameters corresponding to heat and carbon monoxide. Additional input data would be requested at more frequent intervals and comparisons to respective decreased thresholds would be made. If both the particular threshold parameter originally triggered and at least one of the decreased threshold parameters are satisfied, then the fire event has been verified and an alarm is correctly energized.

The system 10 further promotes accurate fire event detection and avoids false alarms by adjusting the threshold parameters to environmental or climatological conditions (hereafter referred to "climatizing" the sensors). As particularly shown in FIG. 2, the logic circuit 24 requests initial input data from the sensors when the fire event detection device is initially powered-up/energized, as indicated at blocks 52 and 50, respectively). The initial input data is compared to corresponding predetermined threshold parameters by the logic circuit 24. If the environmental condition measured by a sensor is within a predetermined range of proximity to a corresponding threshold parameter, the logic circuit 24 is adapted to adjust the respective threshold parameter, as indicated at blocks 54, 56, respectively. Once the threshold parameters have been appropriately "climatized", routine monitoring of the sensors is initiated 58. The logic circuit 24 includes predetermined proximity ranges corresponding to each threshold parameter which indicate whether or not a parameter modification is needed. For example, for a heat sensor, the initial input data may be required to be within 20° F. of the threshold parameter (or even to be above the threshold) in order to merit a parameter modification. An initial temperature reading within such a range would indicate that the fire detection device is in a hot attic at power-up and the threshold level should be significantly increased in order to avoid a climate-induced false alarm.

It is understood that the alarm 28 may include a conventional tone generator which can emit various tones or tone patterns according to the signals received from the logic circuit 24. The alarm 28 may also include a plurality of light emitting diodes (LED's) having various colors which are activated according to signals received from the logic circuit 24. Various audio and visual alarm circuits are known which can process data signals and activate predetermined audio or visual responses accordingly.

In use, a fire detection device utilizing the present system 10 may be positioned at a desired residential or commercial location prior to or in conjunction with initial power-up. At power-up, the logic circuit 24 requests initial input data which is delivered to the logic circuit in a data stream, as indicated at 22 and 20 in FIG. 1. The logic circuit 24 compares this initial input data to predetermined threshold parameters and modifies respective parameters if the comparison indicates a false alarm is likely unless respective parameters are modified. During routine operation, the logic circuit 24 compares input data from the sensors 12, 14, 16 with the predetermined parameters (some of which may have been modified at power-up). If at least two or more threshold parameters indicate a fire event condition, the logic circuit 24 immediately energizes an alarm 28. If only one threshold parameter indicates a fire event condition, then all other threshold parameters are decreased and input data is requested and evaluated at more frequent intervals. If subsequent evaluations reveal that the initially satisfied threshold parameter and at least one of the decreased parameters is satisfied, then the alarm is energized. If a true fire event condition is not determined within a predetermined amount of time, all parameters are returned to their predetermined levels (to their levels following initial power-up modifications).

Accordingly, the present system 10 verifies a detection of a fire event by a fire event detection device before energizing an alarm, whereby to avoid false alarms. The system 10 further enhances accurate detection and yields fewer false alarms by climatizing a detection device's ambient air condition sensors at power-up.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A system for verifying the detection of a fire event condition for use with a fire detection device having multiple air condition sensors, said system comprising:

an alarm;

a programmable logic circuit capable of evaluating input data supplied thereto by the air condition sensors indicative of respective ambient air conditions, said logic circuit including means for generating an output signal to energize said alarm;

wherein said logic circuit includes a plurality of predetermined threshold parameters corresponding to ambient air conditions indicative of respective fire event conditions;

a power source electrically connected to said alarm and said logic circuit; and wherein said logic circuit includes means for comparing said input data to respective threshold parameters, said logic circuit decreasing said threshold parameters other than a particular threshold parameter when said input data is at an undesirable relationship with respect to said particular threshold parameter.

2. The system as in claim 1 wherein said logic circuit is capable of generating said output signal for energizing said alarm if said input data is at an undesirable relationship with at least two of said threshold parameters.

3. The system as in claim 1 wherein said logic circuit is capable of generating said output signal for energizing said alarm if said input data is at an undesirable relationship with said particular threshold parameter and at least one of said decreased threshold parameters.

4. The system as in claim 1 further comprising means in said circuit for resetting said decreased threshold parameters upon expiration of a predetermined time after decreasing said threshold parameters.

5. The system as in claim 1 further comprising means in said circuit for evaluating said input data at more frequent time intervals when said threshold parameters have been decreased.

6. The system as in claim 1 further comprising means in said circuit for requesting at power-up initial input data from the air condition sensors, said circuit including means for comparing said initial input data with respective threshold parameters, said circuit modifying said respective threshold parameters if said initial input data is at a predetermined relationship with said respective threshold parameters.

7. The system as in claim 6 wherein said predetermined relationship with regard to said initial input data and said respective threshold parameters includes a measured air condition that is within a predetermined range relative to a corresponding threshold parameter.

8. The system as in claim 1 wherein said power source is a battery.

9. A method for verifying the accuracy of detection of a fire event condition by a fire detection device utilizing multiple air condition sensors, said method comprising:

providing an alarm;

providing a programmable logic circuit;

providing a power source for said alarm and programmable logic circuit;

demanding from the air condition sensors in the fire detection device input data indicative of respective ambient air conditions;

providing said input data to said logic circuit for comparison with a plurality of predetermined threshold parameters;

if said input data is at an undesirable relationship with a particular threshold parameter, decreasing said threshold parameters other than said particular threshold parameter; and energizing said alarm if said input data is at an undesirable relationship with said particular threshold parameter and at least one of said decreased threshold parameters.

10. The method as in claim 9 further comprising energizing said alarm if said input data is at an undesirable relationship with at least two threshold parameters.

11. The method as in claim 9 further comprising resetting said decreased threshold parameters upon expiration of a predetermined time after decreasing said threshold parameters.

12. The method as in claim 9 further comprising demanding said input data at more frequent time intervals after decreasing said threshold parameters.

13. The method as in claim 9 further comprising:

demanding at initial power-up from the air condition sensors in the fire detection device initial input data indicative of respective ambient air conditions;

providing said initial input data to said logic circuit for comparison with respective threshold parameters; and if said initial input data is at a predetermined relationship with said respective threshold parameters, utilizing said logic circuit to modify said respective threshold parameters.

14. The method as in claim 13 wherein said predetermined relationship includes a measured air condition that is within a predetermined range relative to a corresponding threshold parameter.

15. A method for verifying and improving the accuracy of detection of a fire event by a fire detection device utilizing multiple air condition sensors, said method comprising:

providing an alarm;

providing a programmable logic circuit;

providing a power source for said alarm and programmable logic circuit;

demanding an initial power-up from the air condition sensors in the fire detection device initial input data indicative of respective ambient air conditions;

providing said initial input data to said logic circuit for comparison with a plurality of predetermined threshold parameters; and if said initial input data is at a predetermined relationship with regard to said respective threshold parameters, utilizing said logic circuit to modify said respective threshold parameters;

wherein if said input data is at an undesirable relationship with a particular threshold parameter, decreasing said threshold parameters other than said particular threshold parameter.

16. The method as in claim 15, further comprising:

demanding from the air condition sensors input data indicative of respective ambient air conditions;

providing said input data to said logic circuit for comparison with said threshold parameters; and generating a signal in said logic circuit if said input data is at an undesirable relationship with said particular threshold parameter and at least one of said decreased threshold parameters, said signal energizing said alarm.

17. The method as in claim 16 further comprising generating another signal if said input data is at an undesirable relationship with at least two threshold parameters, said another signal energizing said alarm.

18. The method as in claim 15 further comprising generating a signal if said input data is at an undesirable relationship with at least two threshold parameters, said signal energizing said alarm.

19. The method as in claim 16 further comprising resetting said decreased threshold parameters upon expiration of a predetermined time after decreasing said threshold parameters.

20. The method as in claim 19 further comprising demanding said input data at more frequent time intervals after decreasing said threshold parameters.

* * * * *

UNITED STATES PATENT AND TRADEMARK OFFICE

CERTIFICATE OF CORRECTION

PATENT NO. : 6,788,198 B2
DATED : September 7, 2004
INVENTOR(S) : Harshaw

It is certified that error appears in the above-identified patent and that said Letters Patent is hereby corrected as shown below:

Replace the title page with the attached title page

Drawings,
Sheet 1 of 3, replace the informal drawing of Fig. 1 with the formal drawing of Fig. 1.

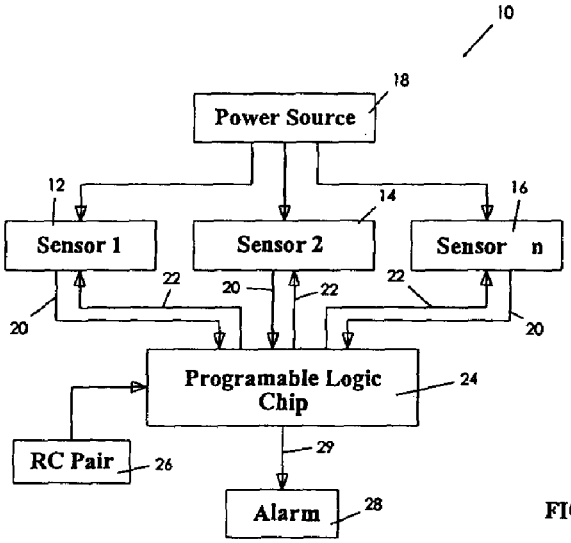

FIG. 1

Figure 2:
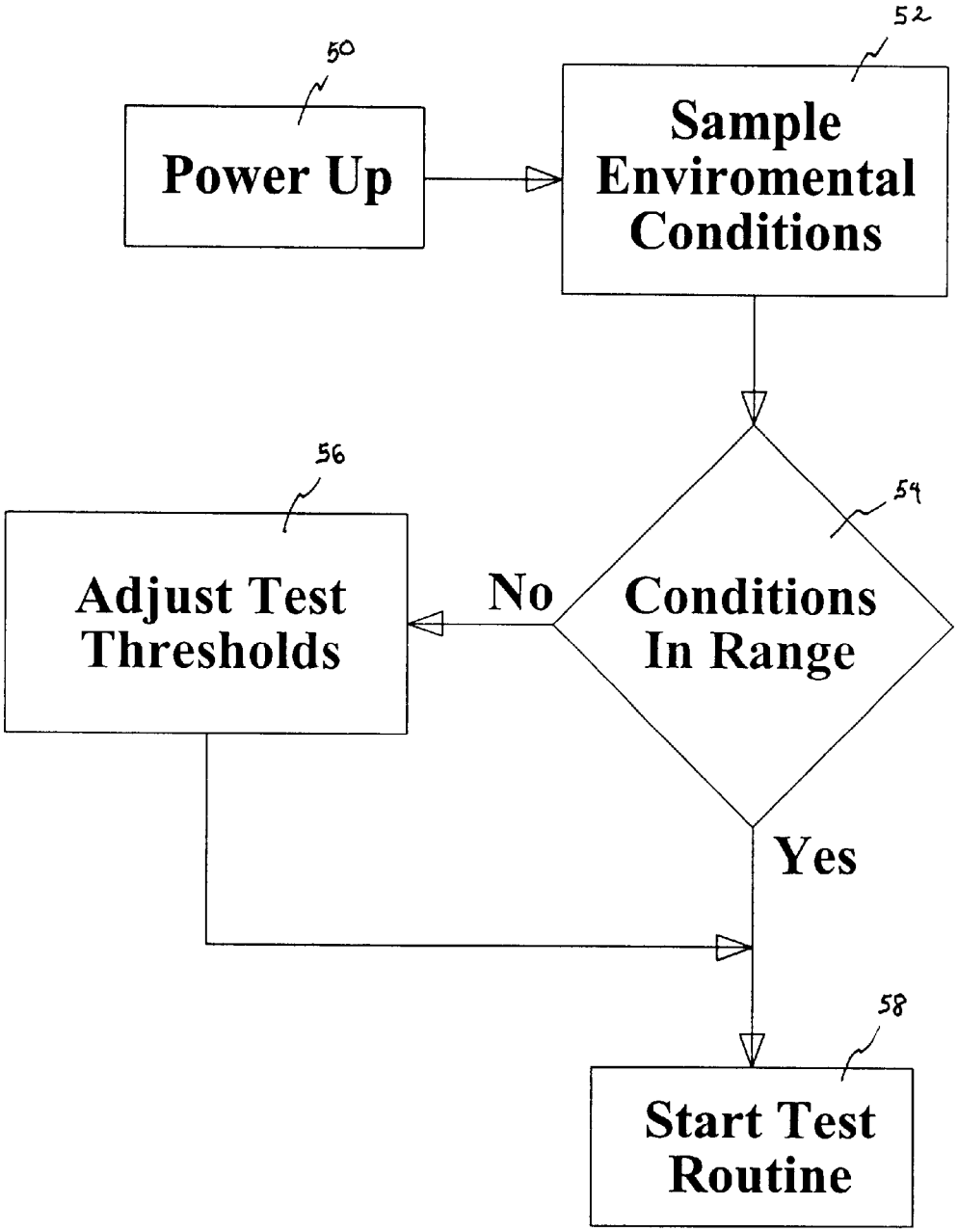
FIG. 2 is a flow chart showing the logic utilized by a programmable logic circuit according to the system of FIG. 1.

Sheet 2 of 3, replace the informal drawing of Fig. 2 with the formal drawing of Fig. 2.

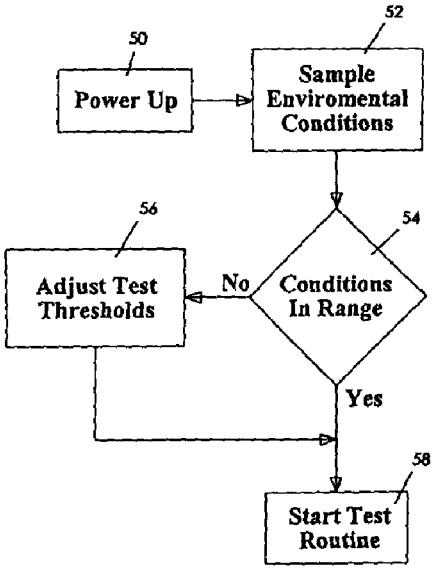

FIG. 2

UNITED STATES PATENT AND TRADEMARK OFFICE

CERTIFICATE OF CORRECTION

PATENT NO. : 6,788,198 B2
DATED : September 7, 2004
INVENTOR(S) : Harshaw

It is certified that error appears in the above-identified patent and that said Letters Patent is hereby corrected as shown below:

Drawings (cont'd),
Sheet 3 of 3, replace the informal drawing of Fig. 3 with the formal drawing of Fig. 3.

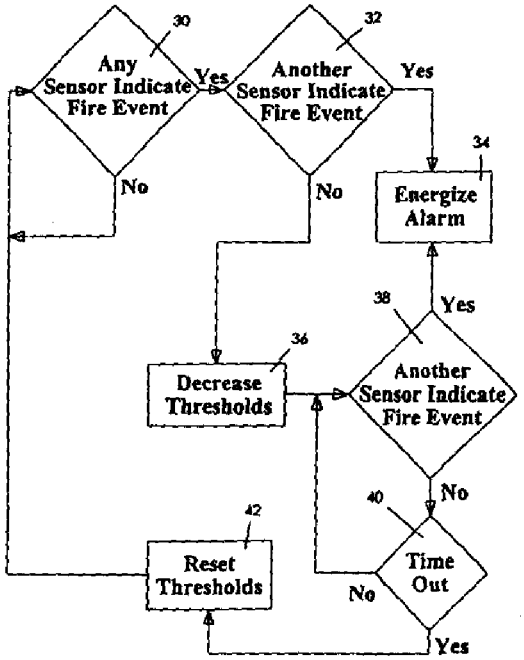

FIG. 3

Signed and Sealed this

Twenty-second Day of March, 2005

JON W. DUDAS
*Director of the United States Patent and Trademark Office*

(12) United States Patent
Harshaw

(10) Patent No.: US 6,788,198 B2
(45) Date of Patent: Sep. 7, 2004

(54) SYSTEM FOR VERIFYING DETECTION OF A FIRE EVENT CONDITION

(76) Inventor: Bob F. Harshaw, P.O. Box 418, Ottawa, KS (US) 66067

( * ) Notice: Subject to any disclaimer, the term of this patent is extended or adjusted under 35 U.S.C. 154(b) by 168 days.

(21) Appl. No.: 10/095,809

(22) Filed: Mar. 12, 2002

(65) Prior Publication Data

US 2003/0174056 A1 Sep. 18, 2003

(51) Int. Cl.[7] ..... G08B 19/00
(52) U.S. Cl. ..... 340/522

(56) References Cited

U.S. PATENT DOCUMENTS 6,314,054 B1 * 11/2001 Priebsch ..... 367/93
6,344,802 B1 * 2/2002 Otsuka et al. ..... 340/517
6,414,594 B1 * 7/2002 Guerlain ..... 340/506
6,597,287 B1 * 7/2003 Steinel ..... 340/541

* cited by examiner

*Primary Examiner*—Daryl Pope
(74) *Attorney, Agent, or Firm*—Dale J. Ream

(57) ABSTRACT

A system for verifying the detection of a fire event by a fire detection device utilizing multiple air condition sensors includes a programmable logic circuit that evaluates whether input data supplied thereto by the sensors satisfies predetermined threshold parameters. If the input data matches one particular parameter, the other threshold parameters are decreased and evaluation frequency is increased. The circuit energizes an alarm if input data from the sensors satisfies the particular parameter and at least one of the decreased parameters or if the input data satisfies at least two non-decreased parameters. Therefore, a fire event sensed by one sensor is verified by another sensor before causing an alarm. At power-up, the circuit compares initial input data with the predetermined parameters and modifies the parameters if the input data is within respective predetermined ranges. This also decreases false alarms.

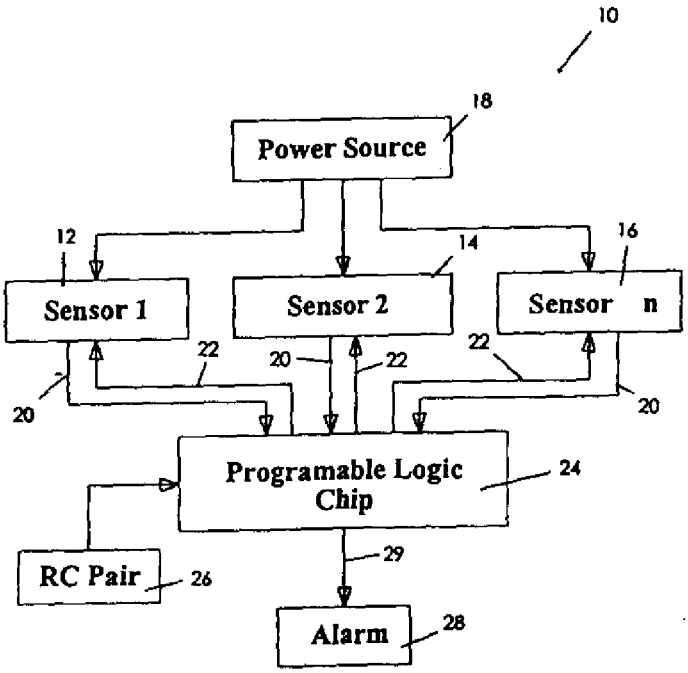

20 Claims, 3 Drawing Sheets